US010669776B2

(12) United States Patent
Carrera

(10) Patent No.: US 10,669,776 B2
(45) Date of Patent: Jun. 2, 2020

(54) RUNG LOCK FRAME FOR A RUNG LOCK ASSEMBLY FOR USE WITH AN EXTENSION LADDER

(71) Applicant: Louisville Ladder Inc., Louisville, KY (US)

(72) Inventor: Abelardo Carrera, San Nicolás de los Garza (MX)

(73) Assignee: Louisville Ladder Inc., Louisville, KY (US)

( * ) Notice: Subject to any disclaimer, the term of this patent is extended or adjusted under 35 U.S.C. 154(b) by 0 days.

(21) Appl. No.: 15/711,631

(22) Filed: Sep. 21, 2017

(65) Prior Publication Data

US 2018/0094485 A1 Apr. 5, 2018

Related U.S. Application Data

(60) Provisional application No. 62/404,480, filed on Oct. 5, 2016.

(51) Int. Cl.
*E06C 7/06* (2006.01)
*E06C 1/12* (2006.01)

(52) U.S. Cl.
CPC . *E06C 7/06* (2013.01); *E06C 1/12* (2013.01)

(58) Field of Classification Search
CPC ..... E06C 7/06; E06C 1/12
See application file for complete search history.

(56) References Cited

U.S. PATENT DOCUMENTS

| | | | | | |
|---|---|---|---|---|---|
| 551,073 | A | * | 12/1895 | Bergedahl | |
| 565,444 | A | * | 8/1896 | Fisk | |
| 864,194 | A | * | 8/1907 | Reimann | |
| 873,110 | A | * | 12/1907 | Williamson | |
| 1,244,645 | A | * | 10/1917 | Schreiner | E06C 7/06 182/210 |
| 3,565,211 | A | | 2/1971 | Le Blanc | |
| 4,299,306 | A | | 11/1981 | Hawkins | |
| 4,467,891 | A | | 8/1984 | Shaw | |
| 5,117,943 | A | | 6/1992 | Schmitt et al. | |
| 5,429,207 | A | * | 7/1995 | Frank | E06C 1/12 182/209 |
| 2002/0079166 | A1 | | 6/2002 | Gaik | |

* cited by examiner

*Primary Examiner* — Alvin C Chin-Shue
(74) *Attorney, Agent, or Firm* — Egbert Law Offices, PLLC

(57) ABSTRACT

A rung lock frame has an upper rung portion, a lower rung portion integrally formed with the upper rung portion, and a bar member formed between the upper rung portion and the lower rung portion. The bar member defines an opening with the lower rung portion for the receipt of a rung of a ladder therein. The upper rung portion, the lower rung portion and the bar member are integrally formed of a glass-reinforced nylon material.

14 Claims, 2 Drawing Sheets

RUNG LOCK FRAME FOR A RUNG LOCK ASSEMBLY FOR USE WITH AN EXTENSION LADDER

CROSS-REFERENCE TO RELATED APPLICATIONS

The present application claims priority from U.S. Provisional Patent Application Ser. No. 62/404,480, filed on Oct. 5, 2016, and entitled "Improved Rung Lock"

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to ladders. More particularly, the present invention relates to rung locks that are used in association with extension ladders. In particular, the present invention relates to rung locks that are formed of a polymeric material.

2. Description of Related Art Including Information Disclosed Under 37 CFR 1.97 and 37 CFR 1.98

Extension ladders typically consist of a base section and one or more fly sections with each fly section extendable from the preceding section. The term "base section" refers to the lower of two adjacent sections of an extension ladder, from which a fly section is extended upward. Thus, a "base section" may be the section of the ladder onto which the user first climbs, or may be a fly section extending from a previous section, for which another fly section is extendable.

Most extension ladders rely on rung locks to hold a fly section in place once it has been extended from a base section. Rung locks are typically attached at one end to the interior of the dual rails on the fly section in a manner which permits an open jaw at the other end of the rung lock to engage a rung on the base section. For ease of extending and contracting the fly section, rung locks are pivotally mounted so that they may be swung away from the rungs of the base section while the fly section is moved up or down.

FIG. 1 illustrates a prior art extension ladder system having the conventional prior art rung lock attached thereto. As can be seen in FIG. 1, a longitudinal extendable extension ladder has to at least two adjacent relatively slidable fly and base ladder sections 3 and 4, respectively, with the base ladder section 4 serving as the stationary section and the fly ladder section 3 being the relatively movable section. The ladder sections can be formed from any one of a number of suitable materials, such as fiberglass or aluminum material. Each of the ladder sections 3 and 4 includes a plurality of spaced ladder rungs 6 which are generally of a circular or "D"-shaped cross-section and which extend normally between and are fastened to a pair of spaced ladder rails 7. One of the ladder sections serves as the base ladder section 4 and the other serves as the fly ladder section 3.

The rung lock frame and latching assembly 8 can be pivotally mounted on one of the relatively slidable ladder sections of an extension ladder. The assembly 8, which includes rung lock frame 9 and a movable latching mechanism 11, can be movably mounted as a rung cooperating spaced pair of rung lock and latching assemblies 8 in or adjacent the inside opposed faces of the pair of ladder rails 7 of the fly section 3. The assembly 8 can be mounted in spaced relation above and engageable with the lowest ladder rung 6 of the fly ladder section 3.

Each rung lock frame 9 is formed of a metallic material, such as an aluminum alloy. The rung lock frame 9 is shaped to include apertured or opened upper and lower rung portions 12 and 13 with a bar member 14 extending therebetween. The lower portion 13 is open-ended, as at 16, so as to provide a C-shaped or U-shaped mouth opening. The mouth is geometrically sized and configured to releasably engage both of a preselected pair of adjacently positioned rungs 6 of the fly ladder section 3 and the base ladder section 4 when the rail mounted rung lock frame has been pivoted into a rung locking position.

Each rung lock frame 9 is formed so that the opposite longitudinally extending faces thereof include the frame bar member 14 which divides rung portions 12 and 13. The frame bar member is recessed so as to reduce overall frame weight. The longitudinally extending edge strengthening ribs 17 and 18 are formed on each of the upper and lower rung portions 12 and 13. In FIG. 1, only one face of the frame 9 is disclosed. It is understood that the opposite face of frame 9 is a mirror-image of the face shown. Ribs 17 are located along preselected edge areas of opposed face edges of rung lock frame 9 and opposed ribs 18 are on opposite faces of frame 9. Ribs 18 are positioned to extend normally between the spaced opposed longitudinally extending edge ribs 17 on the opposite face of bar member 14 at a location intermediate the extremities of bar member 14. The ribs 18 not only serve as strengthening ribs, such as edge ribs 17, but also serve as a guide member for latch 11 pivotally mounted adjacent one extremity of bar member 18 and above open end 16 of the lower aperture portion 13 of rung lock frame 9. The rung lock frame 9 can be provided with a pin-receiving through pivot hole 19 at one extremity of the frame 9. This pivot hole 19 allows for pivotal mounting of the rung lock frame 9 about an inner face of the side rail 7 of fly ladder section 3. The rung lock frame 9 is so spaced from a preselected rung 6, such as the lowest rung, such that the open end 16 of the mouth of lower aperture portion 13 can engage with the lowest rung 6 on fly ladder section 3 and with an adjacent preselected rung 6 on the base ladder section 4.

The first latch 11 of the rung lock frame and latch assembly 8 is pivotally mounted at one extremity thereof on the rung lock frame 9 adjacent the extremity of bar member 14 which divides the upper and lower apertures and portions 12 and 13 of frame 9. The first latch 11 is pivotally positioned adjacent the extremity of bar member 14 at a location above the open end 16 of the mouth of C-shaped lower rung portion 13 of rung lock frame 9. The first latch 111 will be engaged between the rungs of the fly ladder section 3 and the base ladder section 4. A second latch 19 is pivotally mounted to an extremity of the lower rung portion 13. The second latch 19 can be pivoted so as to close the mouth 16 and to lock the rung portions 12 and 13 together in order to fix the rung lock frame 9 to the rungs 6. As such, the relative positions of the fly ladder section 3 and the base ladder section 4 are fixed.

FIG. 2 is an isolated view of the rung lock frame 9 of the prior art. In FIG. 2, it can be seen that there is upper rung portion 12 and lower rung portion 13. The upper rung portion 12 includes a first side member 20 and a second side member 22. The C-shaped opening 16 is formed adjacent to the bar member 14 at the lower end of the upper rung portion 12. An aperture 24 is defined by the side members 20 and 22 and the bar member 14. The aperture 24 has a generally round or circular configuration. The pivot hole 19 is formed at the upper end of the upper rung portion 12. A hook member 26 extends beyond the bar member 14 from the first side member 12. Hook member 26 will extend across a portion of the opening of the C-shaped mouth opening 16. This hook member 26 serves to flexibly latch onto a rung that has been received within the mouth opening 16. The lower rung portion 13 extends downwardly from the bar member 14. As such, the lower rung portion 13 defines a lower portion of the mouth opening 16.

The rung lock of FIGS. 1 and 2 is generally formed of a metallic material. As result, they are relatively expensive to produce. If the rung lock of FIGS. 1 and 2 were formed of a polymeric material, the polymeric material may be relatively heavy and of a rather fragile construction. As such, the rung lock of FIGS. 1 and 2 may not be as sturdy as desired. This rung lock can be subject to abuse or impact.

In the past, various patents have issued relating to such rung locks. For example, U.S. Pat. No. 3,565,211, issued on Feb. 23, 1971 to E. H. Le Blanc, describes an extension ladder rung lock. This retractable rung lock has a pivotal lock body that is normally positioned to engage simultaneously adjacent rungs on relatively movable ladder sections. To permit a selective extension and retraction of the ladder sections, a camming latch is operatively engaged with the lock body. The latch is longitudinally and pivotally movable on a mounting bracket to effect retraction of the lock body during extension or retraction of the ladder sections. The ladder member and the lock body are normally spring-urged to their respective extended positions.

U.S. Pat. No. 4,299,306, issued on Nov. 10, 1981 to H. G. Hawkins, shows an extension ladder lock for an extension ladder. The lock includes a first member forming a guideway which has an open end for receiving stations of the ladder and a second end forming an arm for guiding the lock past the stations of the ladder when the ladder is been extended or retracted. The first member has an elongated projection extending downwardly at the open end of the guideway for containing the stations within the guideway. A pivotal connection between the first member and the second member is located to a first side of a center line of the lock and the projection is located to a second side of the centerline when the lock is freely hanging. When the open end of the guideway is closed by the second member, the tip of the projection, a cam surface of the second member, and the pivotal connection are generally in the same plane which forms an angle of 90° or less with the projection. The lock is swingably connected to the movable frame section, and the pivotal connection between the first member and the second member is located along a lower portion of the first member so that it lies generally above a horizontal plane which bisects a station of the stationary frame section and is coincidentally tangent to the tip of the projection.

U.S. Pat. No. 4,467,891, issued on Aug. 28, 1984 to J. L. Shaw, discloses a lock mechanism for an extension ladder. This lock mechanism comprises a bell crank lever attachable to a fly rail of the ladder to a first pivot. The bell crank lever has first and second joined arm segments extending generally forward and downward, respectively, from their juncture. The first arm segment has a head movable by pivoting the lever between first and second positions at which the head will and will not, respectively, engage base rungs of the ladder. A tongue with a tip is attached to a lower part of the lever's second arm segment through a second pivot. A frame is attachable to the rail during downward sliding of the fly section of the ladder to guide transitory movement of the tongue so that strikings of its tip by base rungs of the ladder are effective to pivot the lever to permit its head to pass by such rung. When the lever head engages the top of a base rung to lock the fly section from downward sliding, the tongue is held against flapping about the second pivot.

U.S. Pat. No. 5,117,943, issued on Jun. 2, 1992 to Schmitt et al., teaches a rung lock assembly for an extension ladder for selectively and releasably locking a pair of adjacent rungs of relatively slidable fly ladder and base ladder sections of the extension ladder. The rung lock assembly includes a rung lock frame pivotally mounted within the fly ladder section that is normally urged into engagement with adjacent rungs of the ladder sections and a pulley and cable system cooperative with the rung lock frame to release and move the same away from such engagement for relative slidable movement of the ladder sections.

U.S. Pat. No. 5,429,207, issued on Jul. 4, 1995 to Frank et al., discloses a rung lock frame and a mechanical latching structural assembly for a selectively releasably locking and releasably and augmentally latching a pair of adjacently positioned rungs of relatively slidable ladder sections of an extension ladder. The rung lock frame and latching structure include guide ribs and inclined ramp arrangements to permit ready movement of the latching structure in to an out of augmental latching positions on the rung lock frame.

U.S. Patent Publication No. 2002/0079166, published on Jun. 27, 2002 to C. W. Gaik, shows a safety latch device for an extension ladder system. At least one rung lock is secured to at least one of the fly section rails and selectively and releasably positionable about at least one base section rung to inhibit movement of the fly section in a generally downward direction. A latching member is rotationally mounted to each rung lock with the latching member selectively movable from a released position to a tensioned position. A biasing mechanism biases the latching member into the released position wherein in the released position, the latching member contacts the same base section rung at each corresponding rung lock.

It is an object of the present invention to provide a rung lock that can be formed of a polymeric material.

It is another object of the present invention to provide a rung lock that has a stronger and sturdier construction than conventional rung locks.

It is another object of the present invention to provide a rung lock that is sturdy.

It is still another object of the present invention to provide a rung lock that is more resistive to abuse and/or impact.

It is still another object of the present invention to provide a rung lock that is quieter than aluminum rung locks.

It is still another object of the present invention to provide a rung lock that reduces wear to the rung during the operation of the rung lock.

It is still another object of the present invention to provide a rung lock that is relatively inexpensive.

These and other objects and advantages of the present invention will become apparent from a reading of the attached specification and appended claims.

BRIEF SUMMARY OF THE INVENTION

The present invention is a rung lock frame that includes an upper rung portion, a lower rung portion integrally formed with the upper rung portion, and a bar member integrally formed between the upper rung portion and the lower rung portion. The rung lock frame, including the upper rung portion, the lower rung portion, and the bar member are integrally formed of a glass-reinforced nylon material. The lower rung portion has a C-shaped or U-shaped opening therein and is adapted to receive a rung therein.

The upper rung portion has an aperture formed therein. This aperture is of a triangular shape having curved vertices. The upper rung portion includes a first side member and a second side member extending downwardly from a juncture in an inverted V-shaped configuration. The second side member has a hook member extending outwardly and downwardly beyond the bar member. Each of the ends of the first and second side members opposite the juncture are connected to the bar member. The hook member opens toward the entrance of the C-shaped or U-shaped opening. Each of the first side member and the second side member have ribs formed thereon. A pivot hole is formed in the upper rung portion generally adjacent to the juncture of the first side member and the second side member. The pivot hole allows the rung lock frame to be pivotally mounted to the inner face of a ladder section. In particular, this ladder section would be the fly ladder section. The hook member has a thickness greater than a thickness of the remainder of the first side member.

The lower rung portion extends downwardly from the bar member. The lower rung portion includes a transition section extending from the first side member of the upper rung portion. This transition section has a greater thickness than the thickness of the first side member. The transition section extends above and below the bar member. The outer edge of the transition section is of a greater thickness than the remainder of the transition section inwardly thereof. This outer edge defines a generally curved flange.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
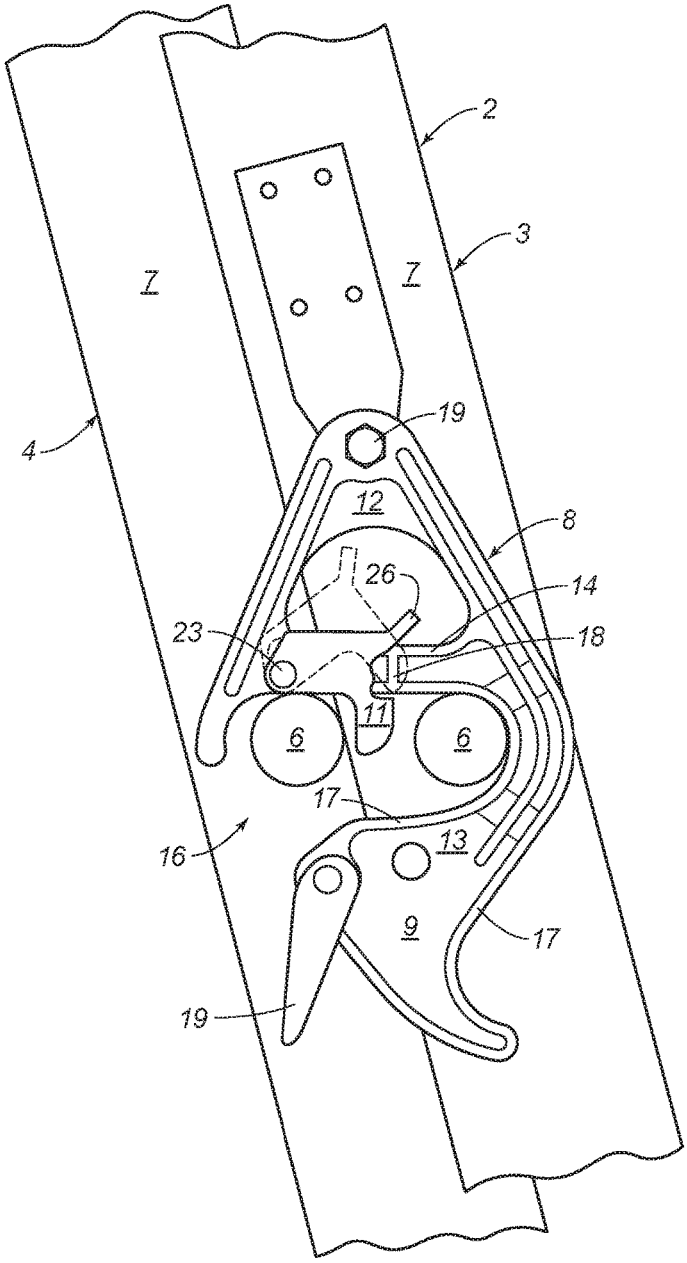
FIG. 1 Prior Art
FIG. 1 is a side elevational view showing a rung lock of the prior art as applied to an extension ladder.
Figure 2:
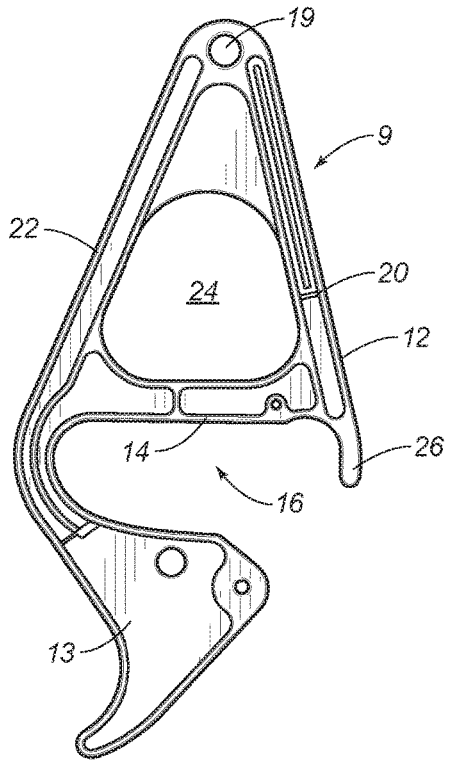
FIG. 2 Prior Art
FIG. 2 is an isolated side elevational view of the prior art rung lock as illustrated in FIG. 1.
Figure 3:
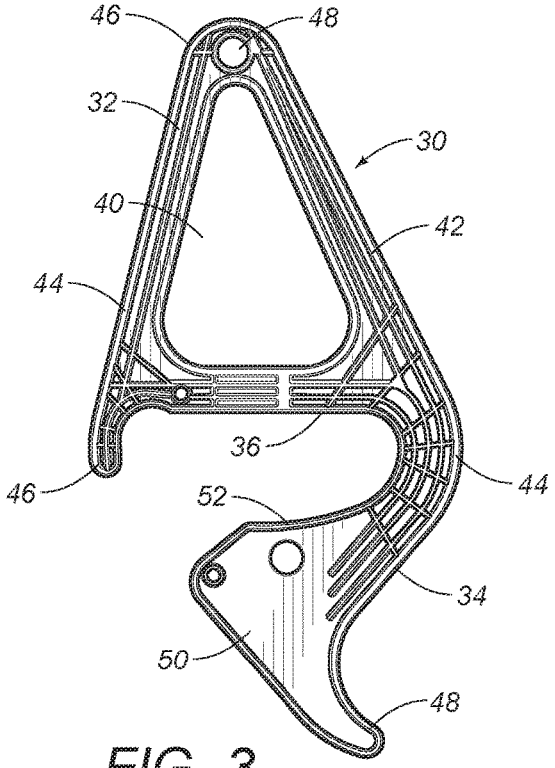
FIG. 3 is a side elevational view showing the improved rung lock in accordance with the present invention.

Referring to FIG. 3, there is shown the rung lock 30 in accordance with the preferred embodiment of the present invention. The rung lock 30 is preferably integrally formed of a glass-reinforced nylon material. Because of the use of this glass-reinforced nylon material, the rung lock 30 is substantially stronger than conventional aluminum rung locks or other polymeric rung locks. The glass-reinforced nylon material has a lighter weight than aluminum or metallic rung locks.

The rung lock 30 of the present invention includes an upper rung portion 32, a lower rung portion 34 and a bar member 36. The bar member 36 and the lower rung portion 34 are integrally formed with the upper rung portion 32. It can be seen that there is a C-shaped or U-shaped opening 38 defined by the lower side of the bar member 36 and the lower rung portion 34. The C-shaped or U-shaped opening 38 is configured so as to receive a rung therein.

The upper rung portion 32 has an aperture 40 formed therein. Aperture 40 has a generally triangular shape. The vertices of this triangular shape are curved. The triangular shape of the aperture 40 serves to substantially reduce the amount of material required for the rung lock 30. This triangular-shaped aperture 40 (in combination with the glass-reinforced nylon material) provides substantially greater structural integrity for the rung lock 30. The curved vertices of the aperture 40 further serve to distribute forces in a more even manner.

The upper rung portion 32 includes a first side member 42 and a second side member 44 that extend outwardly in a generally inverted V-shaped configuration from the juncture 46 at the upper end thereof. A pivot hole 48 is formed through the material of the rung lock 32 at the juncture 46. The first side member 42 has a plurality of strengthening ribs formed thereon. The first side member 42 extends downwardly so as to integrally join with the lower rung portion 34. As such, a transition section 44 will extend between the first side member 42 and the lower rung portion 34. The transition section 44 extends from above the bar member 36 to below the bar member 36. The second side member 32 includes a hook member 46. The hook member 46 extends downwardly beyond the lower edge of the bar member 36 and into the mouth of the opening 38. The hook member 46 will serve to engage the rung in a snap-fit relationship.

The lower rung portion 34 extends downwardly from the bar member 36. The lower rung portion 34 includes a finger 48 that curves outwardly from a side 50 of the lower rung portion 34. The upper edge 52 of the lower rung portion 34 defines the opening 38 with the lower side of the bar member 36. The transition section 44 will extend toward the lower rung portion 34.

Figure 4:
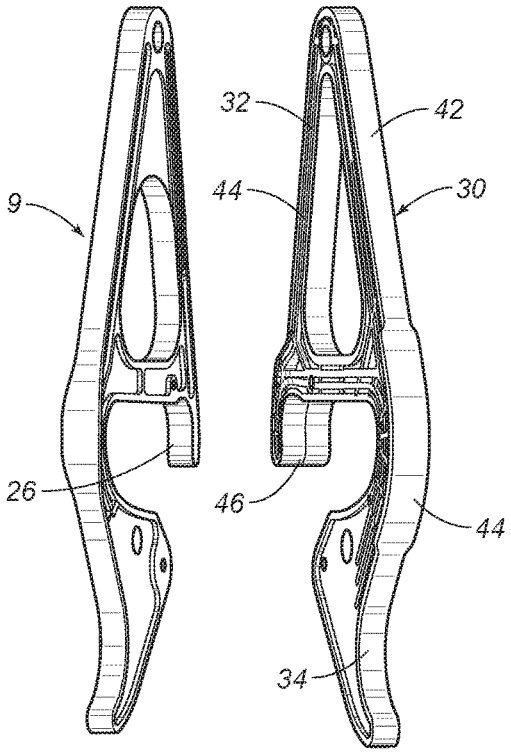
FIG. 4 is a perspective end view showing a comparison between the improved rung lock of the present invention and the prior art rung lock of FIG. 2.

FIG. 4 illustrates a comparison between the rung lock frame 9 of the prior art and the rung lock 30 of the present invention. In FIG. 4, it can be seen that the hook member 46 of the rung lock 30 of the present invention has a greater thickness than the hook portion 26 of the prior art rung lock frame 9. This wider hook member 46 enhances the structural integrity of the hook member 46 in comparison with the prior art. As such, this establishes a stronger and more rigid connection between the rung lock 30 and the rung that is received within the opening 38. It can be seen in FIG. 4 that this hook member 46 actually has a greater thickness than the first side member 44 of the upper rung portion 32. The thickness of the hook member 46 generally corresponds in thickness to the thickness of the bar member 36. Bar member 36 has a greater thickness than the thickness of the first side member 44 of the upper rung portion 32. Once again, this greater thickness further enhances the structural strength and stability of the rung lock 30 of the present invention.

FIG. 4 further illustrates that the first side member 44 of the present invention has a greater thickness than either the second side member and the first side member 42 of the upper rung portion 32 and greater than the thickness of the downwardly extending lower rung portion 34. Once again, the greater thickness of the transition section 44 enhances the strength and integrity of the rung lock 30 in the area that it is needed most, i.e. in the area of connection between the rung lock 30 and the rung.

Figure 5:
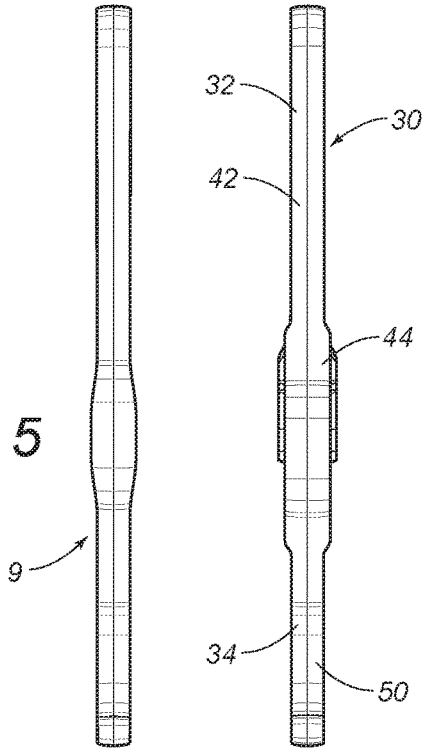
FIG. 5 is an end view of the improved rung lock the present invention in comparison with the rung lock of the prior art of FIG. 2.

FIG. 5 further illustrates the comparison between the improved rung lock 30 of the present invention and the prior art rung lock 9. In FIG. 5, it can be particularly seen that the transition portion 44 has a substantially greater thickness and length than the transition portion 50 of the prior art rung lock 9. This area of greater thickness of the transition section 44 extends above and below the bar member 36. Once again, this area of greater thickness provides strength in the area where it is needed most. It can be seen that the transition section 44 has a greater thickness than the first side member 42 of the upper rung portion 32 and a greater thickness than the lower rung portion 34. The transition section 44 can define a curved flange on the outer surfaces of the transition section 44.

The present invention is lighter and sturdier than prior art rung locks. The rung lock of the present invention is more resistive to abuse or impact than the prior art rung locks. The rung lock the present invention performs is quieter than conventional aluminum rung locks. The glass-reinforced nylon as used in forming the rung lock 30 of the present invention reduces the wear to the rung of the ladder. Ultimately, the cost of the rung lock 30 of the present invention is less or equal to the cost of conventional aluminum rung locks.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A rung lock frame configured to engage a horizontally-extending rung of a ladder, said rung having a longitudinal axis, said rung lock frame comprising:

an upper rung portion;

a lower rung portion integrally formed with said upper rung portion; and a bar member formed between said upper rung portion and said lower rung portion, said bar member defining an opening with said lower rung portion for receipt of a rung of a ladder therein, said upper rung portion and said lower rung portion and said bar member being integrally formed of a glass-reinforced nylon material, said upper rung portion having an aperture formed therein, said aperture being of a triangular shape with curved vertices, said upper rung portion having a first side member and a second side member that extend from a juncture in an inverted V-shaped configuration, said second side member having a hook member extending outwardly and downwardly beyond said bar member, said hook member having a thickness extending parallel to said longitudinal axis of said rung, the thickness greater than a thickness of a remainder of said second side member.

2. The rung lock frame of claim 1, said opening being a C-shaped opening or a U-shaped opening.

3. The rung lock frame of claim 1, each of said first side member and said second side member having ribs formed thereon and extending longitudinally therealong.

4. The rung lock frame of claim 1, said lower rung portion extending downwardly from said bar member, said lower rung portion having a transition section extending from said first side member of said upper rung portion, said transition section having a thickness greater than a thickness of said first side member.

5. The rung lock frame of claim 4, said transition section extending above and below said bar member.

6. The rung lock frame of claim 4, said transition section having an outer edge having a thickness greater than a thickness of remainder of said transition section inwardly thereof.

7. The rung lock frame of claim 6, said outer edge defining a generally curved flange.

8. A rung lock frame configured to engage a horizontally-extending rung of a ladder, said rung having a longitudinal axis, said rung lock frame comprising:

an upper rung portion;

a lower rung portion integrally formed with said upper rung portion; and a bar member formed between said upper rung portion and said lower rung portion, said bar member defining an opening with said lower rung portion for the receipt of a rung of a ladder therein, said upper rung portion having a first side member and a second side member that extend from a juncture in an inverted V-shaped configuration, said second side member having a hook member extending outwardly and downwardly beyond said bar member, said hook member having a thickness extending parallel to said longitudinal axis of said rung, the thickness greater than a remainder of said second side member, said upper rung portion and said lower rung portion and said bar member and said hook member being integrally formed of a glass-reinforced nylon material.

9. The rung lock frame of claim 8, said lower rung portion extending downwardly from said bar member, said lower rung portion having a transition section extending from said first side member of said upper rung portion, said transition section having a thickness greater than a thickness of said first side member.

10. The rung lock frame of claim 9, said transition section extending above and below said bar member.

11. The rung lock frame of claim 9, said transition section having an outer edge having a thickness greater than a thickness of a remainder of said transition section inwardly thereof.

12. The rung lock frame of claim 11, said outer edge defining a generally curved flange.

13. A rung lock frame configured to engage a horizontally-extending rung of a ladder, said rung having a longitudinal axis, said rung lock frame comprising:

an upper rung portion;

a lower rung portion integrally formed with said upper rung portion; and a bar member formed between said upper rung portion and said lower rung portion, said bar member defining an opening with said lower rung portion for receipt of a rung of a ladder therein, said upper rung portion having a first side member and a second side member that extend from a juncture in an inverted V-shaped configuration, said lower rung portion extending downwardly from said bar member, said lower rung portion having a transition section extending from said first side member of said upper rung portion, said transition section having a thickness extending parallel to said longitudinal axis of said rung, the thickness greater than the a thickness of said first side member, said transition section having an outer edge having a thickness greater than a thickness of a remainder of said transition section inwardly thereof, said outer edge being a generally curved flange, said upper rung portion and said lower rung portion and said bar member being integrally formed of a glass-reinforced nylon material.

14. The rung lock frame claim 13, said second side member having a hook member extending outwardly and downwardly beyond said bar member, said hook member having a thickness greater than a thickness of a remainder of said second side member.

* * * * *